US005349798A

United States Patent [19]

Gross

[11] Patent Number: 5,349,798

[45] Date of Patent: Sep. 27, 1994

[54] INSULATING INSERT FOR CONCRETE BLOCKS

[75] Inventor: Jeffrey A. Gross, Nashport, Ohio

[73] Assignee: Fabricating Packaging Materials, Inc., Lancaster, Ohio

[21] Appl. No.: 946,928

[22] Filed: Sep. 17, 1992

[51] Int. Cl.[5] ..... E04B 1/62

[52] U.S. Cl. ..... 52/405.1; 52/309.12

[58] Field of Search ..... 52/404, 405, 407, 309.4, 52/309.8, 309.12, 309.17, 98, 99, 100

[56] References Cited

U.S. PATENT DOCUMENTS 3,546,833 12/1970 Perreton .
3,557,507 1/1971 Wilder ..... 52/404
3,885,363 5/1975 Whittney .
4,193,241 3/1980 Jensen et al. ..... 52/405
4,631,885 12/1986 Iannarelli .
4,887,405 12/1989 Nickerson .
4,986,049 1/1991 Kennedy et al. .
5,062,244 11/1991 Ducharme .
5,066,440 11/1991 Kennedy et al. .
5,070,669 12/1991 Tsai .
5,079,885 1/1992 Dettbarn .
5,092,092 3/1992 Kiekens et al. .
5,099,629 3/1992 Gay .

*Primary Examiner*—Carl D. Friedman
*Assistant Examiner*—Kien Nguyen
*Attorney, Agent, or Firm*—Mary R. Bonzagni

[57] ABSTRACT

An insulating insert is disclosed, that fits into the cores of concrete building blocks. The insert is collapsible widthwise, near its ends, and lengthwise to fit both standard and odd-dimensioned cores. In the preferred embodiment, the invention basically comprises: a generally rectangular body with flat top, bottom, front and rear panels; two segmented endwalls; and opposing slots (T-shaped in cross section) that start at the endwalls and extend from the insert's top to bottom. The horizontal portion of each T-slot permits the insert's end portions to be collapsible widthwise to easily accommodate different-shaped cores, even sash blocks; and each vertical portion permits the overall length of the insert to be reduced to fit smaller cores.

7 Claims, 2 Drawing Sheets

INSULATING INSERT FOR CONCRETE BLOCKS

BACKGROUND OF THE INVENTION

This invention relates to preformed inserts that fit into hollow cavities or cores of concrete building blocks to provide insulation.

Various attempts have been made to insulate masonry building blocks. Included among these is the manufacture of STYROFOAM ® inserts that can be slid into masonry block cavities of various sizes and shapes. These foam inserts are intended to prevent the transfer of heat or cold from inexpensively constructed buildings (e.g., factories), where the buildings' inner walls are actually the "inside" faces of the masonry blocks. In these buildings, there is no inside paneling or sheet metal, so the blocks must be well insulated to prevent large "heat" transfers.

These inserts are made specifically for three common-sized concrete blocks. These common-sized concrete blocks comprise approximately seventy percent of the market. There is, however, another thirty percent of the market that is comprised of "odd-sized" or "odd-shaped" concrete blocks (e.g., they can have different lengths or non-rectangular cross sections). When dealing with these varied concrete blocks, it is nearly impossible to fit prior inserts (like that shown in U.S. Pat. No. 5,062,244 to Ducharme) into all the differently dimensioned cavities. Yet, workmen typically try to "make" the insert fit, rather than waste time obtaining a different-sized version than the one on hand. If too large of an insert is then forced inside a smaller cavity, it is usually damaged or destroyed and, thus, rendered useless. On the other hand, if a user tries to use a smaller insert in a larger cavity, the insert is typically too small to be of any use.

Manufacturers of these common-sized inserts have nonetheless attempted to make and sell multiple odd-sized inserts. This is often times economically frustrating, however, because the insert manufacturers must undergo expensive retooling. This retooling is not only costly, it is also time consuming.

Accordingly, it is the primary object of the present invention to provide a block insert that is sufficiently collapsible both widthwise and lengthwise to fit even odd-sized cavities in concrete building blocks.

It is another object to provide a block insert with unique T-slots at both ends that collapse to allow the insert to be wedged into different-shaped cavities.

It is a more specific object to provide a block insert with a T-slot at each end, whereby the vertical portion of the "T" permits widthwise collapsing, and cooperates with the horizontal portion of the "T" to allow substantial lengthwise reduction, when desired.

The above and other objects and advantages of this invention will become more readily apparent when the following description is read in conjunction with the accompanying drawings.

SUMMARY OF THE INVENTION

The present invention is a preformed block for insulating the cores of different-dimensioned building blocks. The preferred embodiment basically comprises a generally rectangular body having flat top, bottom, front, and back panels, plus two endwalls. At each endwall, there is a T-slot that extends from the block's top to bottom. Each slot is T-shaped in cross section, with the bottom of the "T" starting at the endwall and the rest of the "T" extending into the block's body, such that the two T's oppose one another. These T-slots allow the preferred embodiment to be collapsible sufficiently to fit within many different-sized cavities.

DETAILED DESCRIPTION OF THE PREFERRED EMBODIMENT

Figure 1:
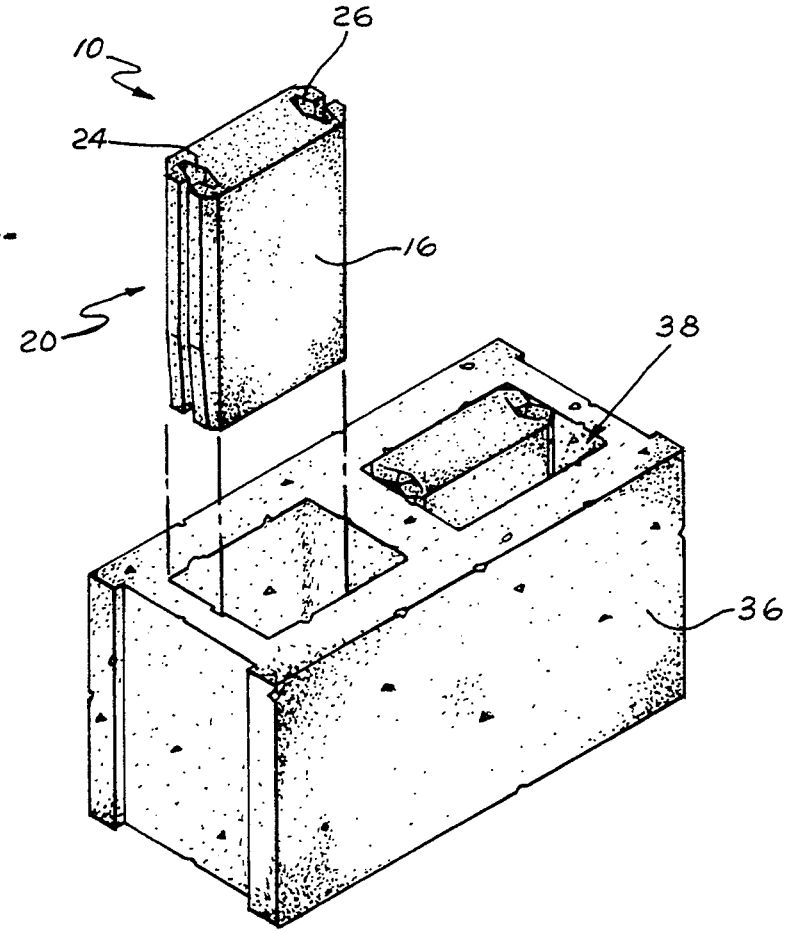
FIG. 1 is a top perspective view of a concrete building block having a pair of similar cavities or cores, with an insulating insert (constructed in accordance with the present invention) above one of the cavities for downward entry into the cavity and a similar insert disposed within the other cavity.
Figure 2:
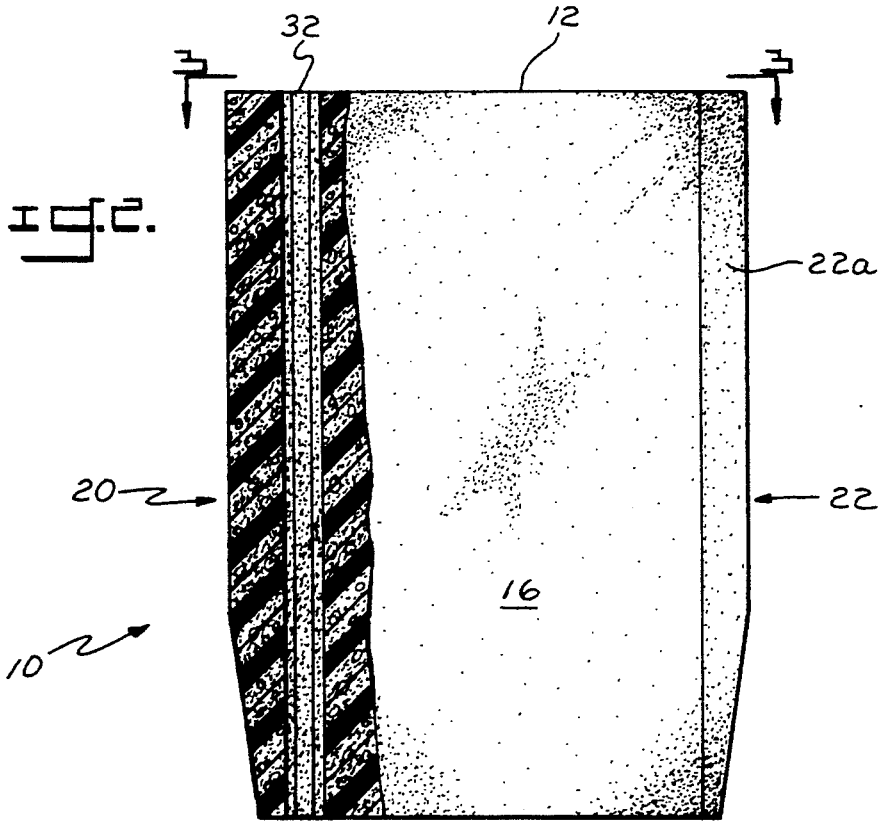
FIG. 2 is a front elevational view of a FIG. 1 insert with a portion broken away to show part of a T-slot.
Figure 3:
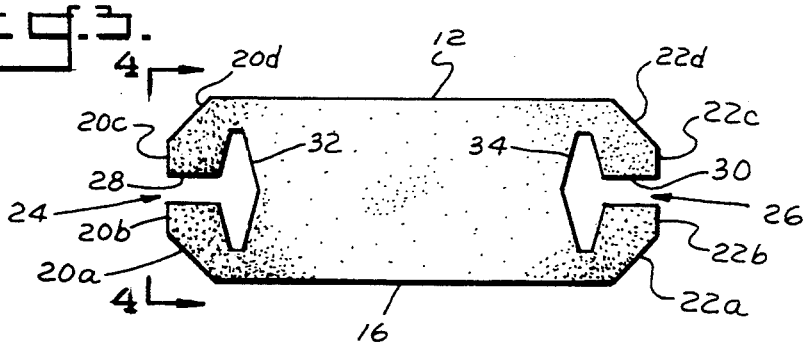
FIG. 3 is a top plan view taken along line 3—3 of FIG. 2, showing opposing T-slots in end portions of the insert.
Figure 4:
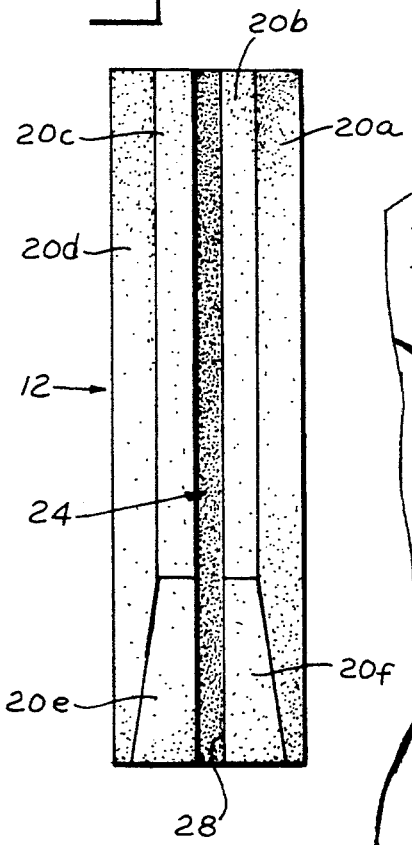
FIG. 4 is an elevational view taken along line 4—4 of FIG. 3, showing an endwall with the start of a T-slot.

Referring to the drawings in detail, a preferred embodiment of the inventive insulating insert is shown and designated by the reference numeral 10. It is marketed under the trademark, FABRI-CORE TM, by Fabricated Packaging Materials, Inc. of Lancaster, Ohio.

The inventive insert 10 is molded from any suitable material, such as expandable polystyrene (EPS). EPS, which is commonly known in the art, is a hard, rigid thermoplastic polymer that is easily colored and molded for application as a structural material.

As best shown in FIGS. 1–4, insert 10 is basically comprised of a top panel or upper face 12; a bottom panel or lower face 14; a front panel or face 16; a back panel or face 18; two endwalls or sidewalls 20, 22; and two slots 24, 26 that are T-shaped in cross section (hereafter referred to as "T-slots"), which allow the insert to be compressible both lengthwise and widthwise.

The T-slots 24, 26 oppose one another and are identical. As viewed from the top of the insert in FIG. 3, or anywhere along its height in cross section, each T-slot has two portions: a vertical portion (28 or 30) of the "T"; and a horizontal portion (32 or 34). Each vertical portion 28, 30 is a straight channel or furrow that starts at an endwall 20, 22; and each horizontal portion 32, 34 is a diamond-shaped channel.

As best seen in FIG. 1, the insert's top, bottom, front, and back panels 12, 14, 16, 18 are all basically flat, straight surfaces (with the only interruptions being the T-slots 24, 26 that open into the top and bottom panels). The endwalls 20, 22, on the other hand, are not straight surfaces. Each endwall is substantially curved and comprised of six segmented portions 20*a*, 20*b*, 20*c*, 20*d*, 20*e*, 20*f* and 22*a*, 22*b*, 22*c*, 22*d*, 22*e*, 22*f*. Two segments 20*a*,20*d* or 22*a*, 22*d* slope outwardly from the insert 10. Two other segments 20*b*, 20*c* and 22*b*, 22*c* of each endwall do not meet, leaving a furrow that serves as the vertical portion (28 or 30) of a T-slot. Near the bottom panel 14 of the insert, the remaining two portions 20*e*, 20*f* and 22*e*, 22*f* of each endwall 20, 22 are tapered inwardly (at 45 degrees) to facilitate insertion into a concrete block, such as 36.

The standard dimensions for the preferred insert 10 (which is slightly larger than the cores in which it can be inserted) are approximately 7.5 inches high, 2 inches thick, and from 4 12/16 to 5 9/16 inches at its upper surface, and from 4 to 4 13/16 inches at its lower surface. The furrows 28, 30 are each ¼ inch wide and 5/8 inch long. The diamond-shaped portions or horizontal portions 32, 34 are each ⅜ inch high, at their midportions, tapering to 3/16 inch at their sides. The overall width of each T-slot 24, 26 is 1⅜ inches, and the overall height is 1 inch.

To place the inventive insert 10 within the concrete blocks, such as 36, the insert 10 is fitted into the core opening, such as 38. Because of the furrow, the width of the insert's end portions can be dramatically reduced to change the rectangular shape to even an oval; and the furrows' cooperation with the diamond-shaped channels 32, 34 permit a significant reduction lengthwise, of about 5 percent, to allow the insert to fit into smaller cavities.

Unlike the prior insert in U.S. Pat. No. 5,062,244 to Ducharme, the illustrated insert 10 can be easily collapsed in a uniform manner along the entire height of the product. In Ducharme, however, its diamond-shaped channel is only partial, as are the compression slots that extend upwardly from its lower face. Ducharme's combination permits little compressibility, and it is not uniform.

Figure 5:
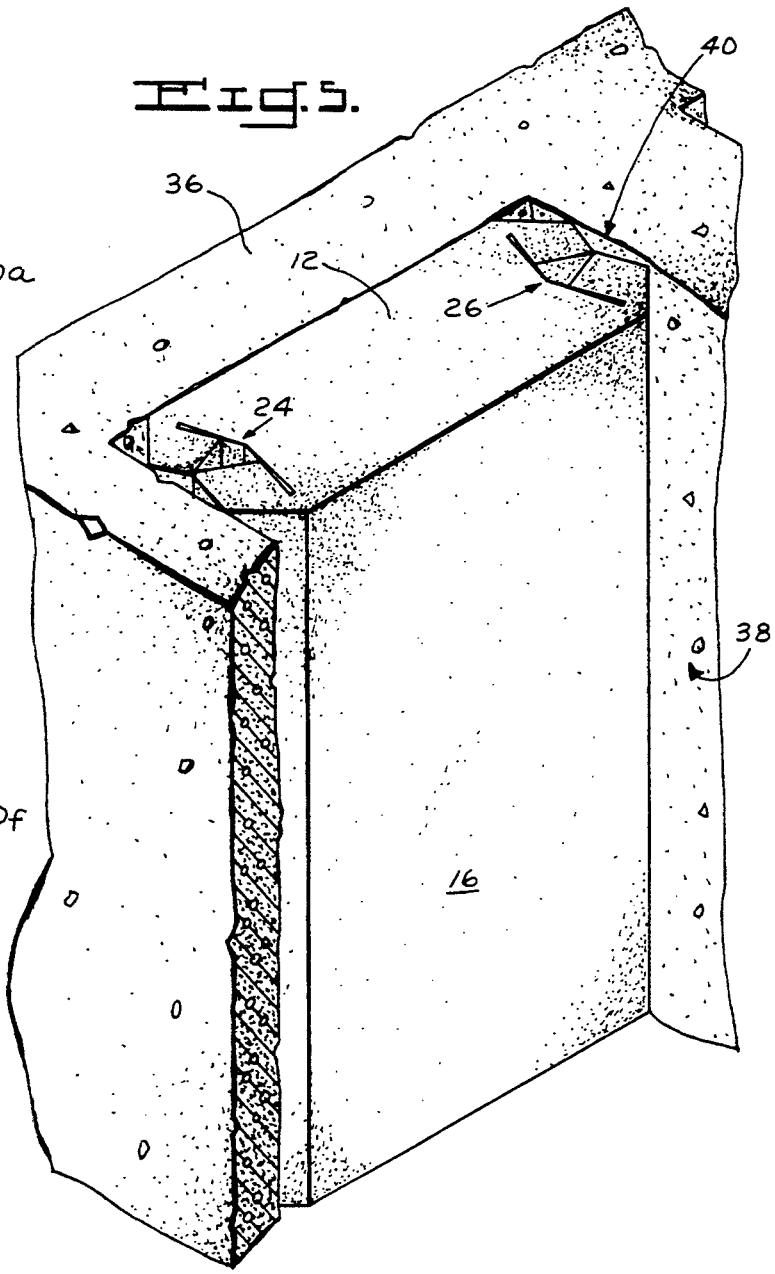
FIG. 5 is an enlarged view of the FIG. 1 insert disposed in the concrete building block, with portions of the building block removed for clarity.

The T-slots 24, 26 of the present invention also overcome a problem that was found with many prior inserts. Those inserts could not readily fit into sash blocks, which have a rounded protrusion or bulge (not shown) at a sidewall of the hollow cavity. That location is depicted by reference numeral 40 in FIG. 5, even though the bulge is not shown. Because of the wide furrow 30, the present insert's endwall 22 can be partially collapsed to accommodate the bulge. Other inserts, however, do not have this adaptability.

It should be understood by those skilled in the art, that obvious structural modifications can be made without departing from the spirit of the invention. For example, the specific shape of the outer surface of the insert and the specific shape of the internal channels, as detailed and described, should not be considered limiting. Accordingly, reference should be made primarily to the accompanying claims, rather than the foregoing specification, to determine the scope of the invention.

Having thus described the invention, what is claimed is:

1. An insulating insert for the cores of building blocks, said insert comprising a generally rectangular body having: top, bottom, front and rear panels; two segmented endwalls with contiguous end portions; and collapsing means in said end portions for allowing both widthwise and lengthwise reduction of the insert, to adapt the insert to fit snugly within non-rectangular cores and cores of different lengths, wherein said means comprises opposing T-slots that start at the endwalls and extend all the way through the insert, from the top to bottom panels.

2. The insert of claim 1, wherein each T-slot, in cross section, has a vertical portion and a contiguous horizontal portion, wherein said vertical portion is defined by a furrow that starts at an endwall and said horizontal portion is defined by a open slot that is diamond-shaped, whereby the horizontal portion of each T-slot permits the insert's end portions to be collapsible widthwise to easily accommodate different-shaped cores, even sash blocks, and the vertical portion of each T-slot permits an initial overall length of the insert to be reduced to fit smaller cores.

3. The insulating insert of claim 2, wherein the widthwise reduction with the T-slots permits the insert to be snugly fit within even oval-shaped cores.

4. The insulating insert of claim 2, wherein the initial overall length of the insert can be reduced up to five percent by collapsing the T-slots.

5. The insulating insert of claim 1, wherein a lower portion of each endwall tapers toward the bottom panel to ease the insert's insertion into a core opening.

6. An insulating insert for the cores of building blocks, said insert comprising a generally rectangular body having top, bottom, front and rear panels; and two segmented endwalls with opposing T-slot means for permitting end portions of the insert to be collapsible both widthwise and lengthwise to fit different-shaped and different-dimensioned cores.

7. The insulating insert of claim 6, wherein the T-slot means allows the insert's end portions to be collapsible to accommodate odd-shaped cores, even a sash block with a central bulge on a core's side.

* * * * *